US011674359B1

(12) United States Patent
Howard et al.

(10) Patent No.: US 11,674,359 B1
(45) Date of Patent: Jun. 13, 2023

(54) SYSTEMS, METHODS AND APPARATUS FOR STABILIZING A DOWNHOLE TOOL AND FLUID FLOW

(71) Applicants: ERDOS MILLER, INC., Houston, TX (US); BLACK DIAMOND OILFIELD RENTALS, LLC, The Woodlands, TX (US)

(72) Inventors: Steven Paul Howard, Broussard, LA (US); Christopher W. Lane, Conroe, TX (US); Charles Kibbe, Conroe, TX (US); Kyle W. Scholl, Peoria, IL (US)

(73) Assignees: ERDOS MILLER, INC., Houston, TX (US); BLACK DIAMOND OILFIELD RENTALS, LLC, The Woodlands, TX (US)

( * ) Notice: Subject to any disclaimer, the term of this patent is extended or adjusted under 35 U.S.C. 154(b) by 0 days.

(21) Appl. No.: 17/518,250

(22) Filed: Nov. 3, 2021

(51) Int. Cl.
*E21B 17/10* (2006.01)
*E21B 17/22* (2006.01)
*E21B 19/24* (2006.01)

(52) U.S. Cl.
CPC ..... *E21B 17/1078* (2013.01); *E21B 17/22* (2013.01); *E21B 19/24* (2013.01)

(58) Field of Classification Search
CPC ..... E21B 17/1078; E21B 17/22; E21B 19/24
See application file for complete search history.

(56) References Cited

U.S. PATENT DOCUMENTS 6,776,247 B1 * 8/2004 Bassal ..... E21B 17/1078 166/241.2
7,493,949 B2 * 2/2009 Baird ..... E21B 10/26 175/323
10,208,545 B2 * 2/2019 Newman ..... E21B 17/1078
2019/0040694 A1 * 2/2019 Smith ..... E21B 17/1078

* cited by examiner

*Primary Examiner* — Yong-Suk (Philip) Ro
(74) *Attorney, Agent, or Firm* — Dickinson Wright PLLC

(57) ABSTRACT

A centralizer for stabilizing fluid flow through a hollow shaft has a body with an axis, an outer surface and a circumference. Fins extend from the outer surface and include a first pair of fins that are axially aligned with each other and circumferentially spaced from each other. A second pair of fins are axially spaced a first distance from the first pair of fins. The second pair of fins are axially aligned with each other and circumferentially spaced from each other. The first and second pairs of fins are circumferentially offset from each other.

18 Claims, 18 Drawing Sheets

SYSTEMS, METHODS AND APPARATUS FOR STABILIZING A DOWNHOLE TOOL AND FLUID FLOW

TECHNICAL FIELD

The present disclosure relates generally to drilling systems. More specifically, the present disclosure relates to a centralizer with fins, where the centralizer couples to a drill string of a drilling system.

BACKGROUND

Drilling systems for drilling hydrocarbon wells typically use one or more centralizers to maintain the drill string at or near the axial center of the well. Centralizers have a plurality of fins that extend from an outer surface of a tubular body of the centralizer. The space between the outer diameter of the fins and the outer diameter of the tubular body is referred to as an annulus. The annulus permits fluid flow around the tubular body and fins. The fluid flow can become turbulent as it flows around the fins, which can adversely affect production. Accordingly, improvements in centralizer design continue to be of interest.

SUMMARY

An aspect of the disclosed embodiments includes a body for stabilizing fluid flow through a hollow shaft or pipe. The body may comprise a longitudinal axis and an outer surface defining a circumference of the body. A plurality of fins may extend from the outer surface. The fins may comprise a first pair of fins that are axially aligned with each other and circumferentially spaced from each other. The fins may comprise a second pair of fins that that may be axially spaced apart from the first pair of fins. The second pair of fins may be axially aligned with each other and circumferentially spaced from each other. The first pair of fins and the second pair of fins may be circumferentially offset from each other.

An aspect of the disclosed embodiments may include an assembly for a downhole tool. The downhole tool may comprise a body that may have an axis and an outer surface that defines a circumference of the body. First and second fins may extend radially from the centralizer opposite each other, and the first and second fins may be axially aligned with each other. A third fin may extend radially from the centralizer and may be one of radially and axially spaced from the first and second fins. The fins, when viewed in a radial direction, may each comprise an asymmetric shape, meaning that the leading and trailing edges of the fin are not symmetric. Examples include shapes such as a teardrop, boat-like or Kamm tail profile. In one version, the centralizer may have no other fins other than the first, second, and third fins. Alternatively, the fins can be arranged in a spiral array or configuration where each fin is axially spaced apart from the others in a spiral-like pattern around the tool.

An aspect of the disclosed embodiments may include an assembly for a downhole tool. The assembly may comprise a centralizer that may have an axis and an outer surface defining a circumference of the centralizer. The first and second fins may extend radially from the centralizer opposite each other, and the first and second fins may be axially aligned with each other. Third and fourth fins may extend, opposite each other and radially from the centralizer. The third and fourth fins may also be axially aligned with and axially spaced from the first and second fins by an axial separation. The centralizer may have no other fins other than the first, second, third and fourth fins.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

The following discussion is directed to various embodiments of the present disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment. Accordingly, various modifications and additions can be made to the exemplary embodiments discussed without departing from the scope of the present disclosure. For example, while the embodiments described below refer to particular features, the scope of this disclosure also includes embodiments having different combinations of features and embodiments that may not include all of the below described features.

Figure 1:
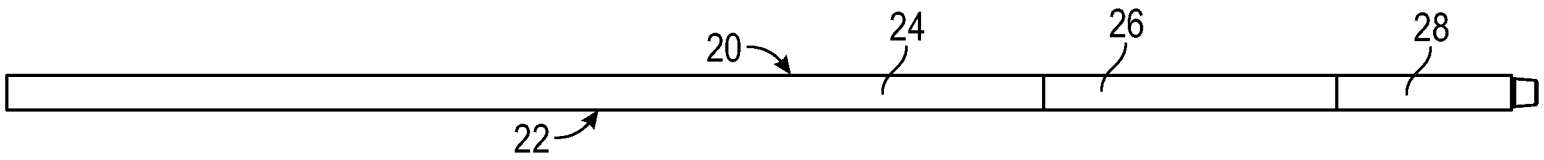
FIG. 1 illustrates a side view of an embodiment of a drilling assembly.
Figure 2:
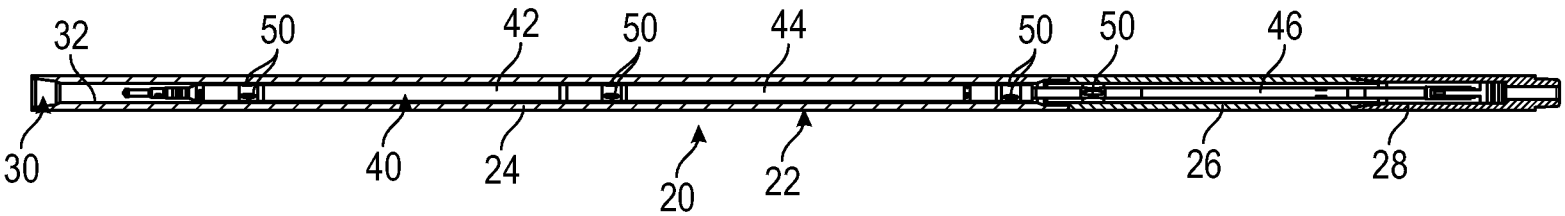
FIG. 2 illustrates a sectional view of an embodiment of the drilling assembly of FIG. 1, taken along a longitudinal axis.

The present disclosure discloses embodiments for fins on a downhole tool, such as for a portion of a drilling system. More specifically, the embodiments herein may include a centralizer, comprising the fins, in a drilling system. Generally, and with reference to the exemplary drilling system 20 illustrated in FIGS. 1 and 2, a drilling system 20, including like drilling system, may be configured to drill well boreholes in the earth to extract fluids, such as oil, water, and gas. The drilling system 20 may include a drill string 22 configured to bore the well borehole in the earth for extraction of a fluid and/or gas downhole (i.e., at the bottom of the borehole). The drill string 22 may include tubing or a drill pipe, such as a pipe made-up of jointed sections 24, 26, 28, and a drilling assembly 30 that may include a downhole tool coupled to a distal end of the drill string 22. A drill bit (not illustrated) typically couples to a distal end of the drilling assembly 30, and the drilling assembly 30 may be positioned in or about a drill string channel, such as channel 32 illustrated in FIG. 2.

To bore into the earth, the drilling assembly 30 may comprise a motor (not illustrated) that rotates the drill string 22 and/or drill bit for boring the well borehole. Additionally, a drilling fluid or "mud" is pumped through the drill string channel 32, exiting at the drill bit, to irrigate, lubricate and cool the drill bit and the downhole environment (i.e., immediate area of the drill bit) and also carry drill cuttings from the bottom of the hole back to the surface. With the continuous flow of the drilling fluid to the drill bit, the drilling fluid mixes with debris from the drilling process to become a mud-like fluid (e.g., hence the reference to the drilling fluid as "mud") which pushes towards the surface in the space between the drill string and the well borehole. Once at the surface, the mud is cleaned and recirculated.

Typically, a downhole tool 40 is installed in the channel 32, and may comprise one or more downhole tool sections 42, 44, 46 (e.g., above the measurement while drilling (MWD) sections 26, 28), which are coupled to and extend from the downhole tool 40. To stabilize the downhole tool 40 in the channel 32, fins 50 may be coupled to one or more of the downhole tool sections 42, 44, 46. The fins 50 stabilize the downhole tool 40, and the downhole tool section 42, 44, 46, relative to an internal wall of the drill string 22. The fins 50, however, can inhibit flow or cause turbulent flow of the drilling fluid as the drilling fluid passes through the channel 32 of the drill string 22. Accordingly, the present disclosure describes embodiments for fins 50 configured to reduce or minimize disruption of the flow of the drilling fluid and stabilize the downhole tool 40 and/or the downhole tool section 42, 44, 46. It should be appreciated that the present disclosure is contemplated for use in other drilling systems and industrial and commercial products.

Figure 3:
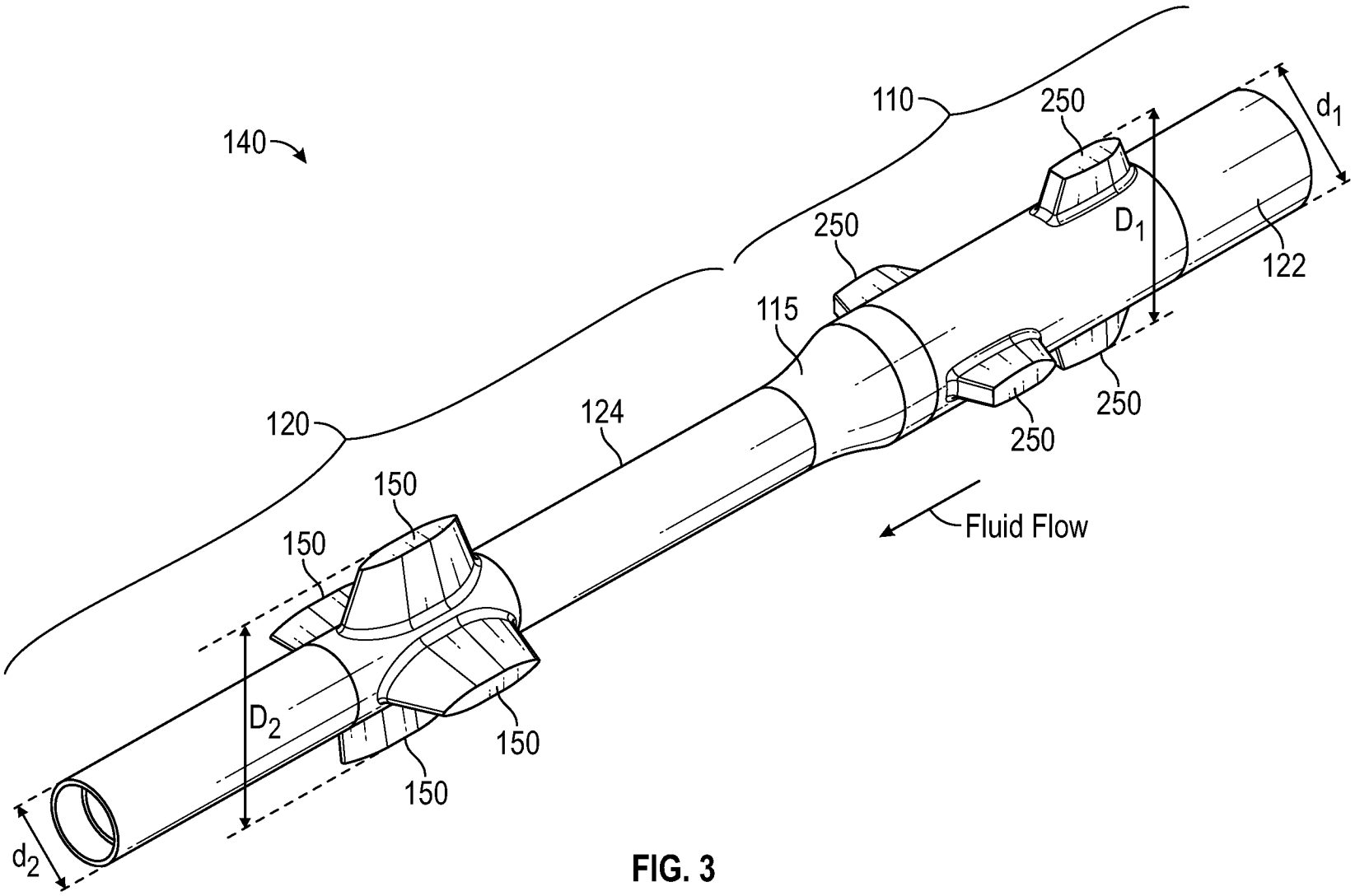
FIG. 3 illustrates a perspective view of an assembly of centralizers on a drilling assembly.

With reference to FIG. 3, the present disclosure may comprise a downhole tool 140 that comprises a first downhole tool section 110 and a second downhole tool section 120. In FIG. 3, the fluid flow direction is right to left, as indicated by the large arrow. The first and the second downhole tool sections 110, 120 may comprise diameters that differ from each other at their respective outer surfaces 122, 124. For example, the first downhole tool section 110 can have a larger tubular diameter d1 than the smaller tubular diameter d2 of the second downhole tool section 120. Alternatively, d1 and d2 may be the same dimension, or d1 can be smaller than d2. The overall outer diameters D1 and D2, taken at the outer edges of the respective fins 250, 150, can be substantially similar or even identical. A transition section 115 can be located between the two different diameters d1, d2.

In embodiments of the present disclosure, fins 150, 250, 350, 450, 550, 650 extend from or couple to a respective radial or outer surface 122, 124, 262, 362, 462, 562, 662. Hereinafter, and unless specifically referenced, the use of fin or fins refers to any one of the illustrated fins 150, 250, 350, 450, 550, 650, and radial or outer surface(s) may refer to any one of the illustrated radial or outer surface(s) 122, 124, 262, 362, 462, 562, 662. The fins may couple to and extend from the radial surface of a body 20, 120, 260, 360, 460, 560, 660. Hereinafter, and unless specifically referenced, the use of body or bodies refers may refer to any one of the illustrated bodies. For example, the fins may be glued or otherwise fastened (e.g., such as rubber molding and vulcanization on centralizer metal bodies) to the radial surface of the body. The fins may also be integral and monolithic with the radial surface and/or body. For example, the fins and the body may form an integral and monolithic sleeve, where the sleeve couples to a hollow shaft, body, downhole tool section, or the like.

In embodiments of the present disclosure, such as the those illustrated in FIGS. 3-10, the fins 150, 250, 350, when viewed in a radial direction, are each axially and circumferentially symmetric. In embodiments of the present disclosure, such as the exemplarily ones illustrated in FIGS. 10-28, fins 450, 505, 650, when viewed in a radial direction can be axially symmetric and circumferentially asymmetric. For example and with reference to FIGS. 11-16, the fins 450, 550, when viewed in a radial direction, comprises, present, or define, a teardrop shape. In the examples of FIGS. 17-23, when viewed in a radial direction that is perpendicular to the longitudinal axis of the tool, the fins 550 can comprise bullet-like or boat-like shapes. The thickness of each shape can be determined by computational flow dynamics (CFD), with total allowable flow area and flow velocities or pressure drop. A polynomial equation (see example, below) can determine un-trimmed (phantom) chord length from the leading edge (LE) to the trailing edge (TE). A resultant chord length of the boat-like shape (from bow to stern) can be determined by finding a location along the fin profile where the cross-sectional area (thickness by radial height) is half that of the cross-sectional area at the location of maximum fin thickness, and taking that as the cut-off point (at the stern). These shapes also can be referred to as a Kamm tail profile, Kammback, Kamm tail or K-tail. The Kamm tail profile may be defined as a shape where the trailing edge is truncated at the location where the cross-sectional area is equal to about half of the maximum cross-sectional area, as viewed in the radial direction (i.e., perpendicular to the longitudinal axis of the body to which the fin is coupled).

Figure 5:
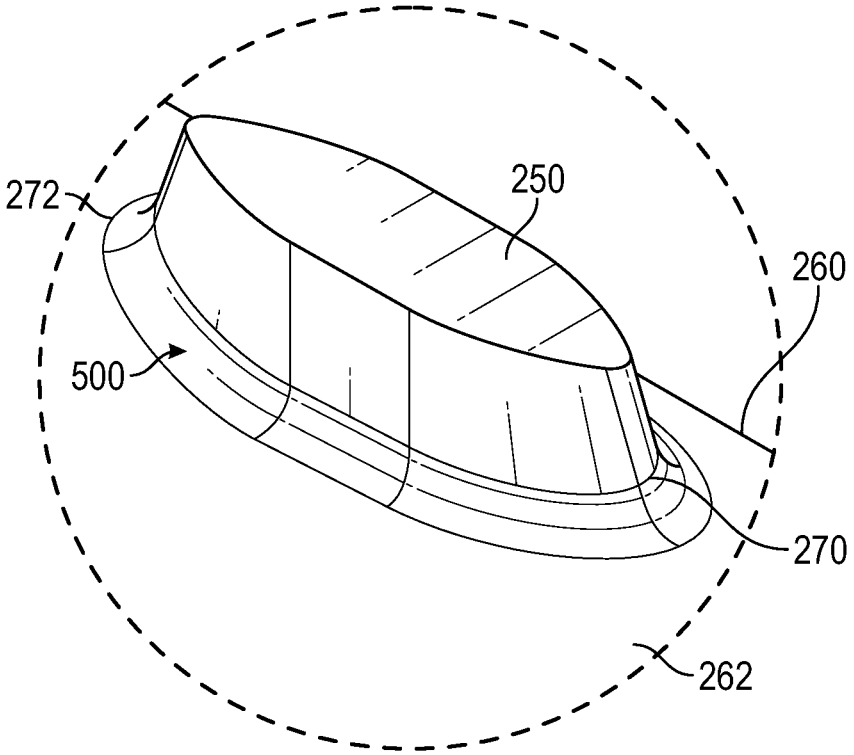
FIG. 5 illustrates a perspective view of a fin of the centralizer of FIG. 4.
Figure 6:
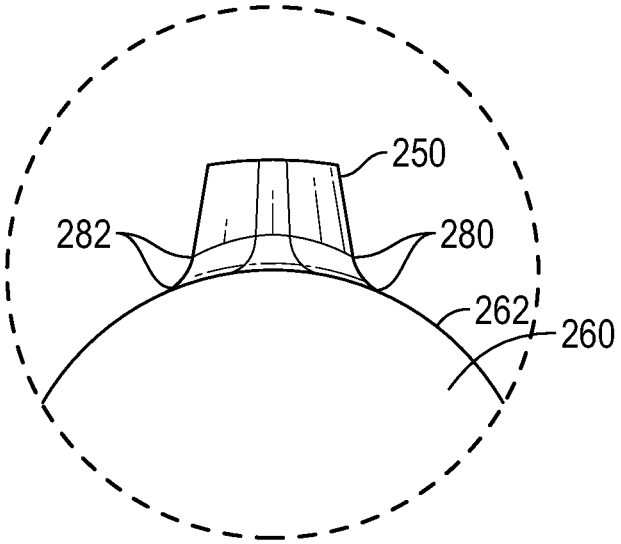
FIGS. 6 and 7 are front and rear views, respectively, of a fin of the centralizer of FIG. 4.
Figure 7:
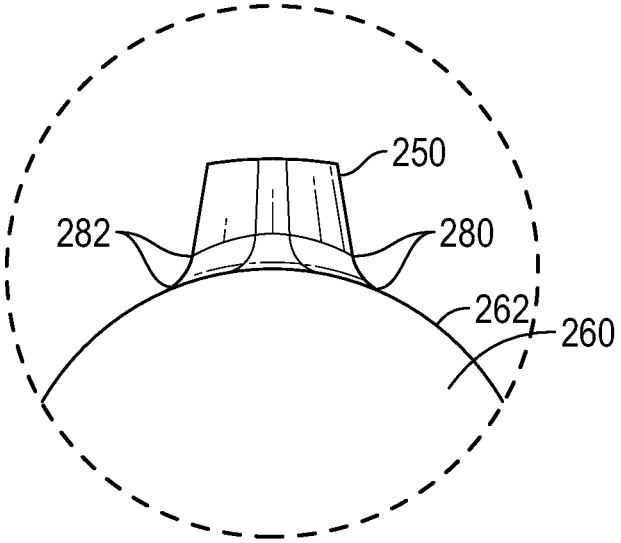
Figure 8:
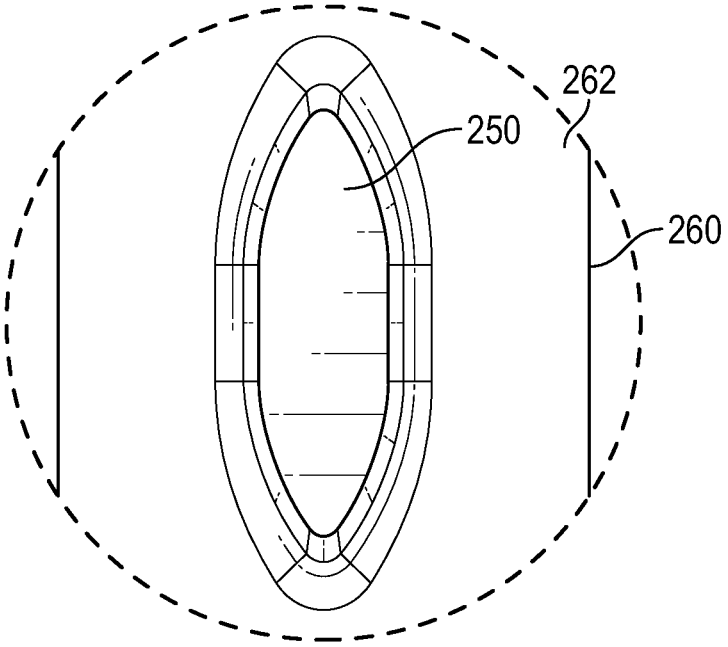
FIG. 8 is a top view of a fin of the centralizer of FIG. 4.
Figure 9:
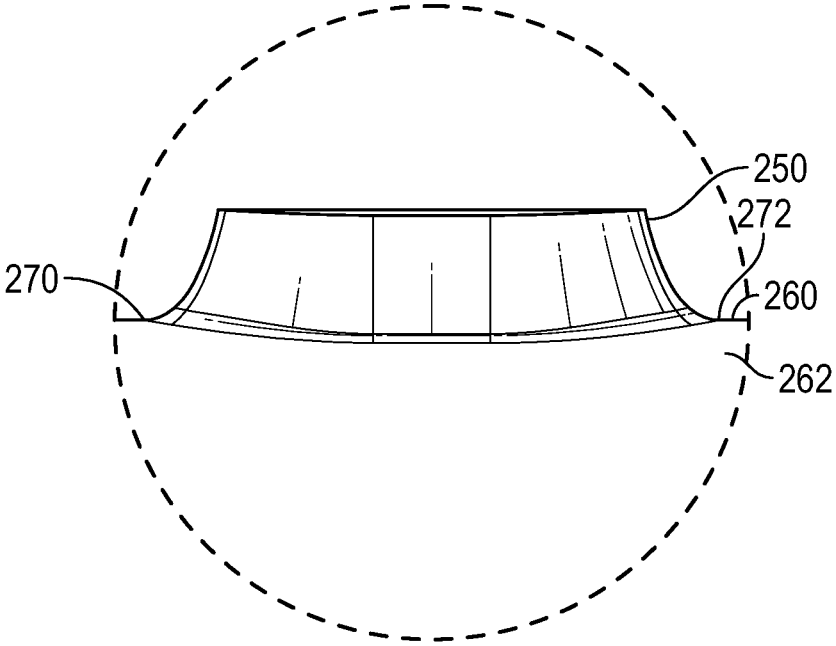
FIG. 9 is a side view of a fin of the centralizer of FIG. 4.
Figure 10:
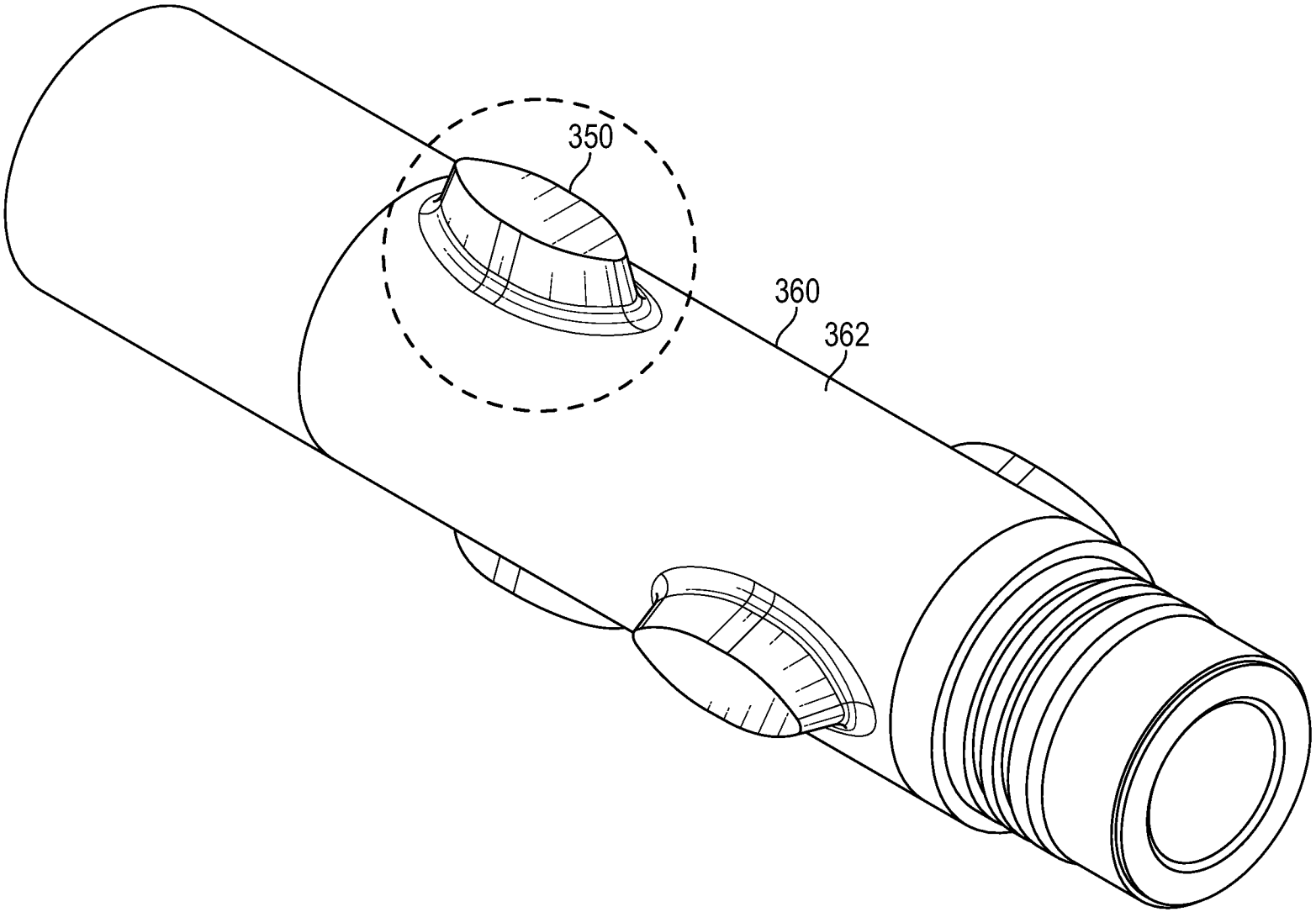
FIG. 10 is a perspective view of another embodiment of a centralizer and fins.
Figure 11:
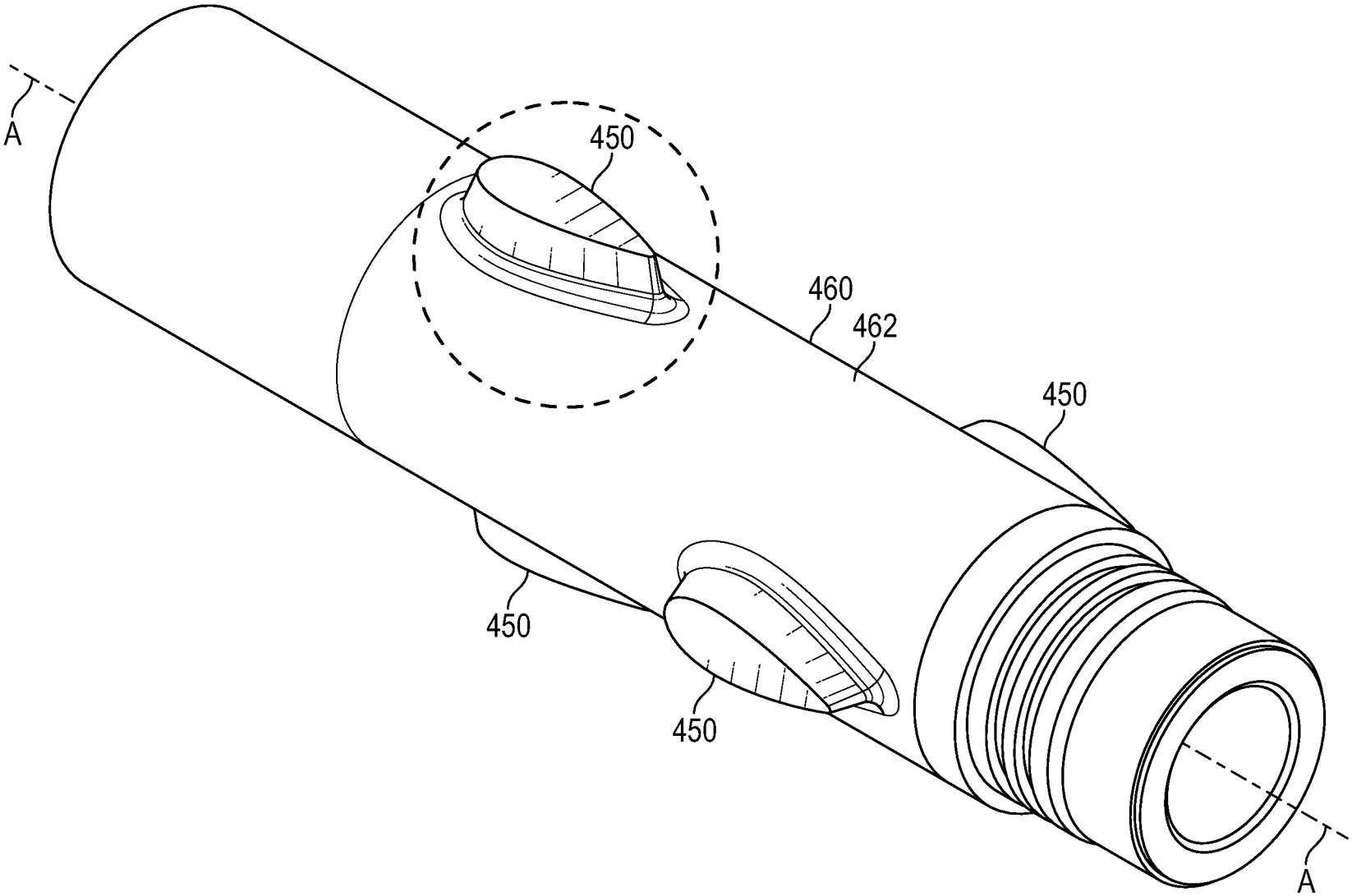
FIG. 11 is a perspective view of still another embodiment of a centralizer and fins.
Figure 12:
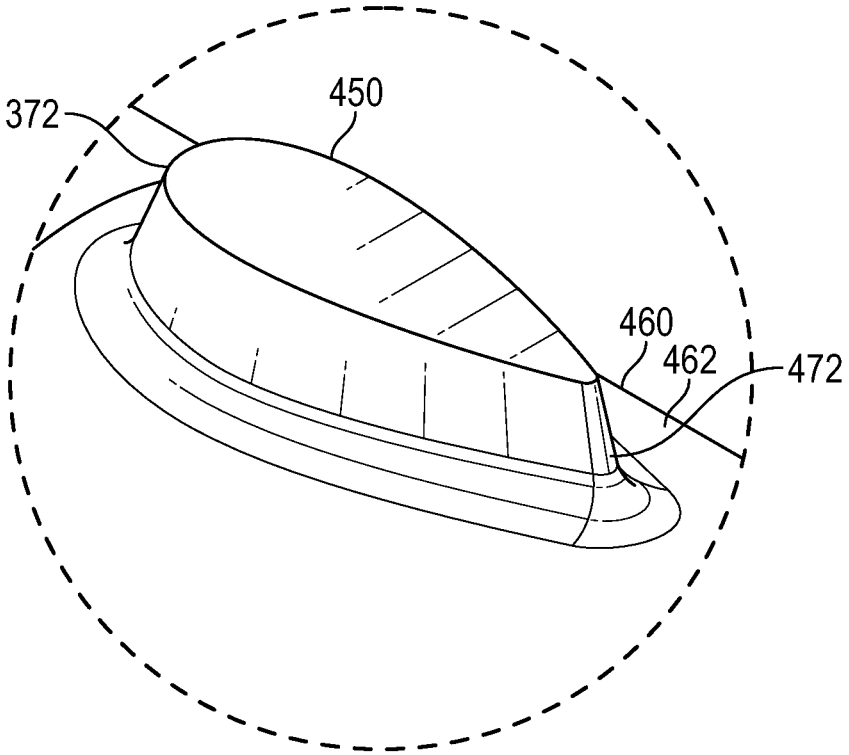
FIG. 12 is a perspective view of a fin of the centralizer of FIG. 11.
Figure 13:
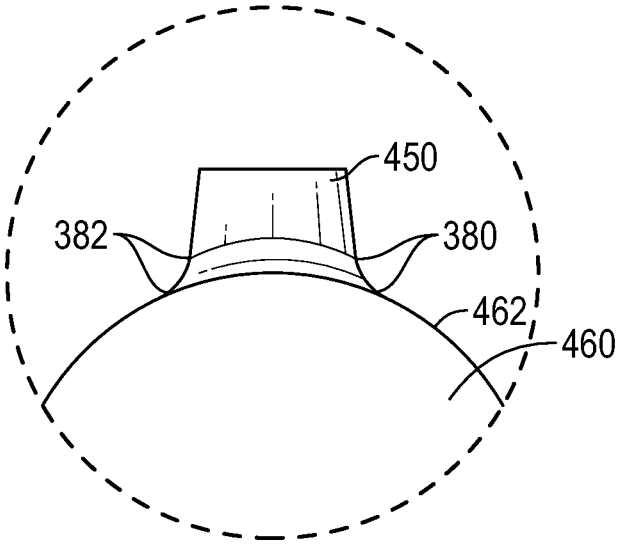
FIGS. 13 and 14 are front and rear views, respectively, of a fin of the centralizer of FIG. 11.
Figure 14:
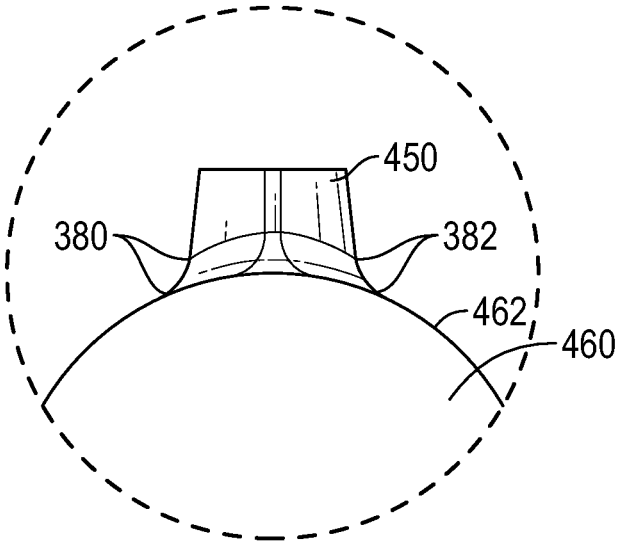
Figure 15:
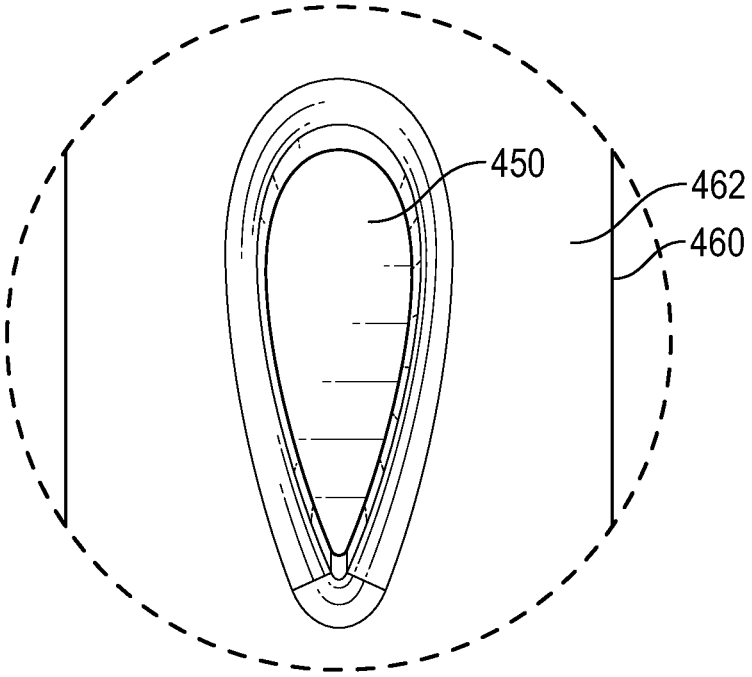
FIG. 15 is a top view of a fin of the centralizer of FIG. 11.
Figure 16:
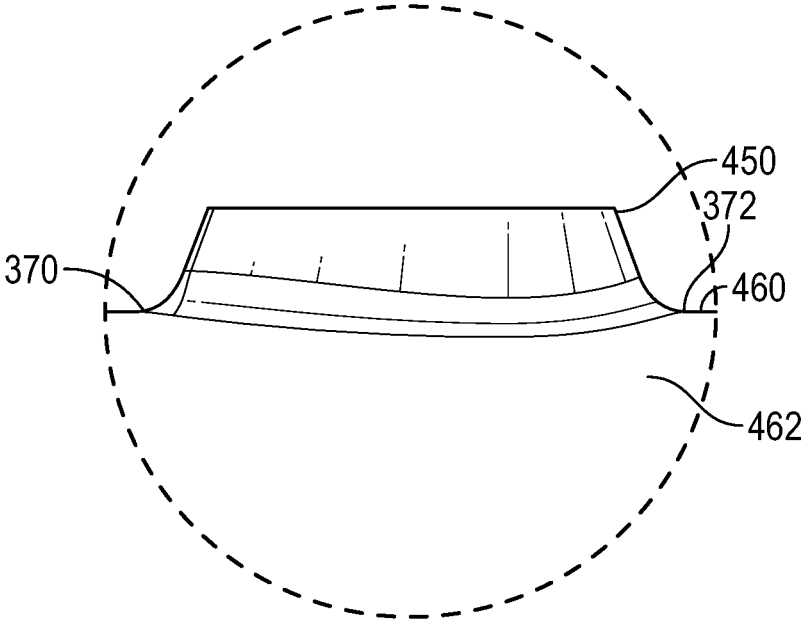
FIG. 16 is a side view of a fin of the centralizer of FIG. 11.
Figure 17:
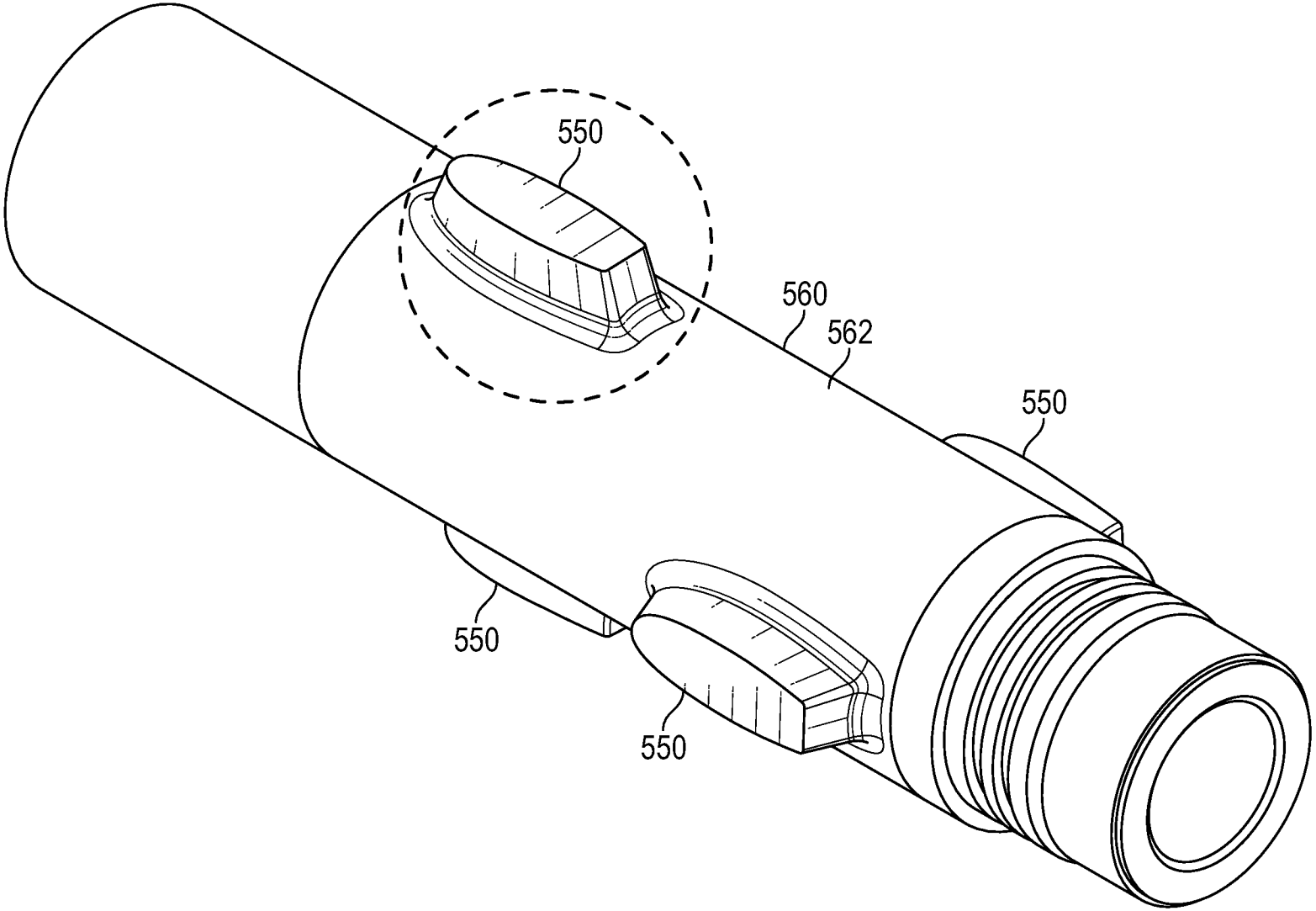
FIG. 17 is a perspective view of yet another embodiment of a centralizer and fins.
Figure 18:
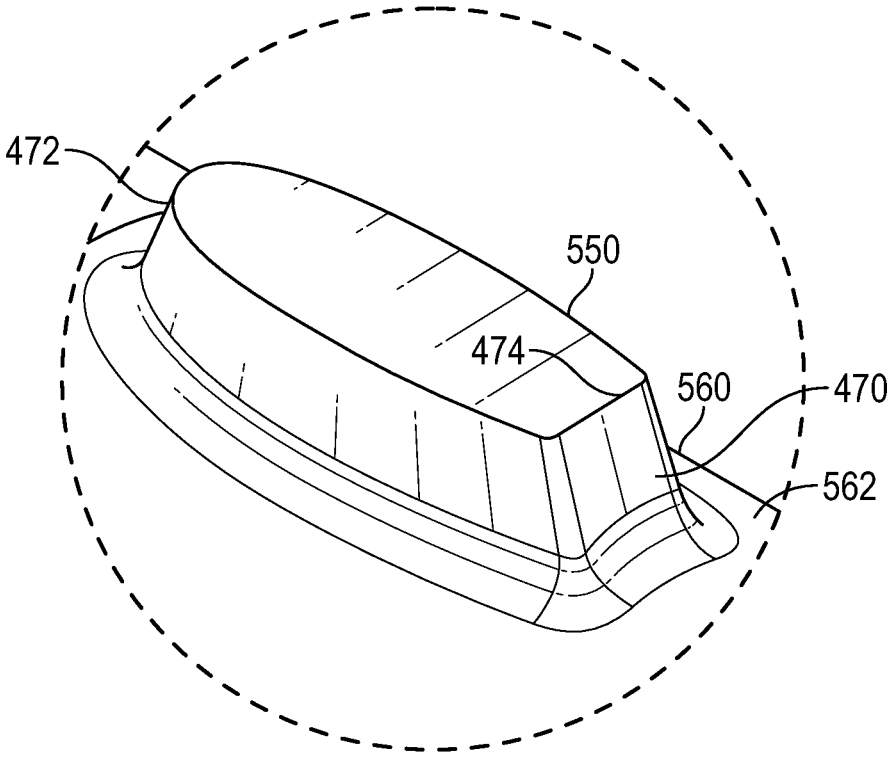
FIG. 18 is a perspective view of a fin of the centralizer of FIG. 17.
Figure 19:
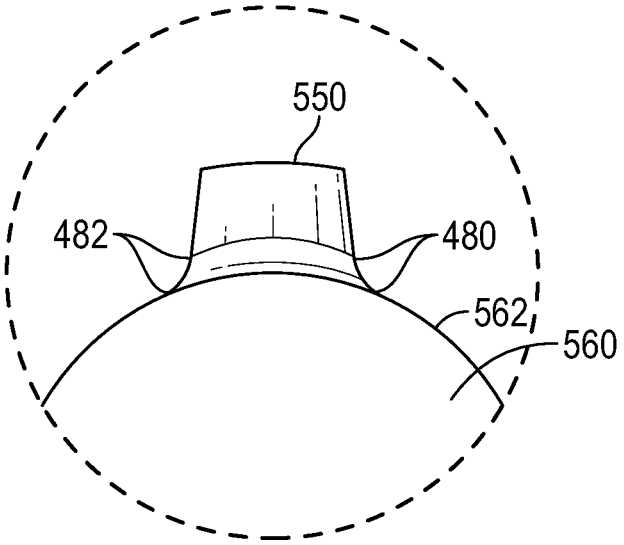
FIGS. 19 and 20 are front and back views, respectively, of a fin of the centralizer of FIG. 17.
Figure 20:
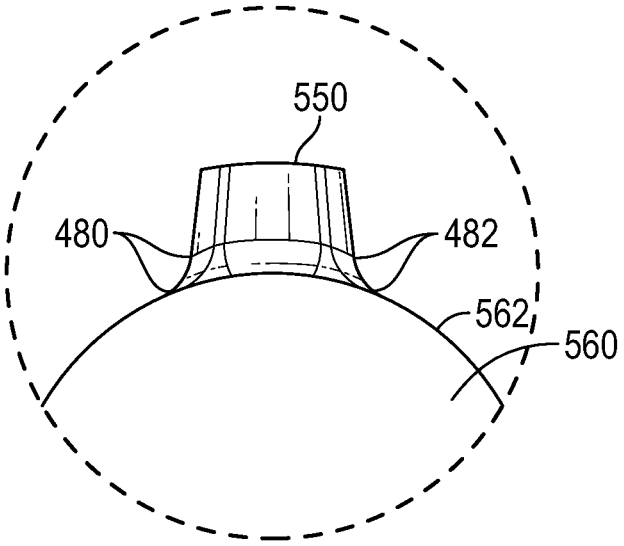
Figure 21:
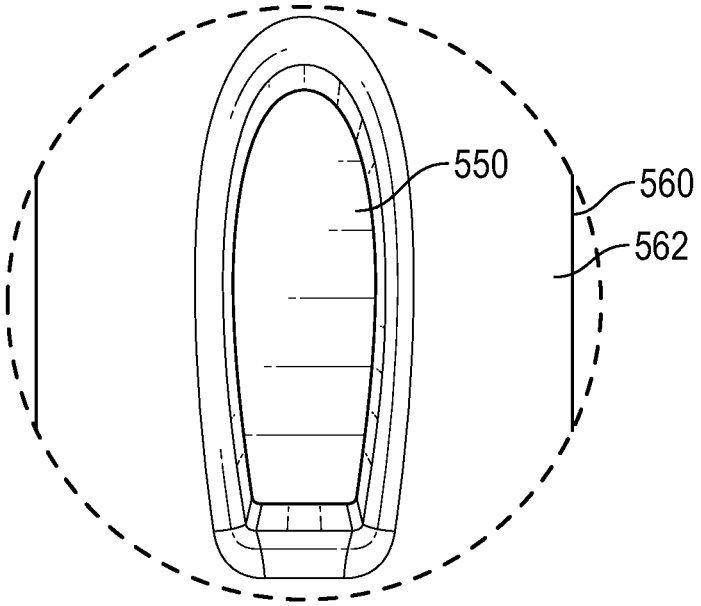
FIG. 21 is a top view of a fin of the centralizer of FIG. 17.
Figure 22:
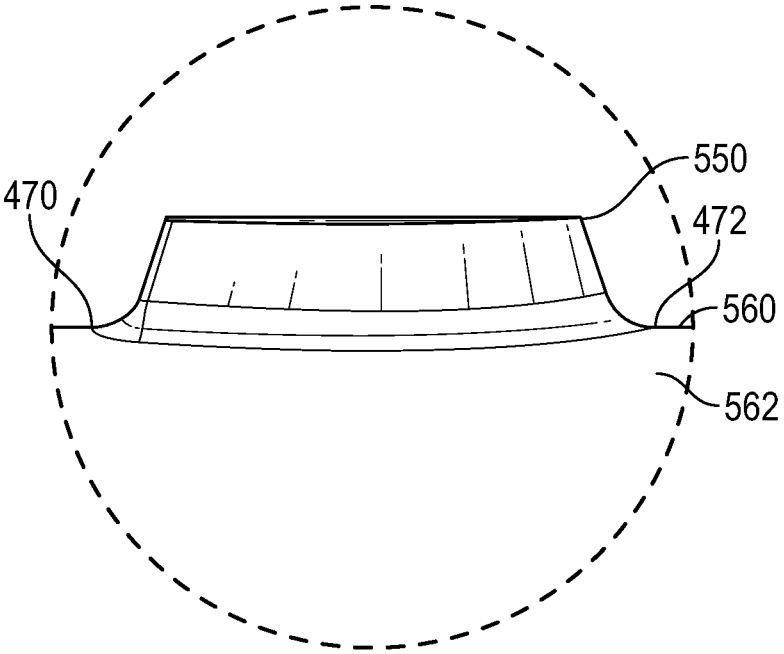
FIG. 22 is a side view of a fin of the centralizer of FIG. 17.
Figure 23:
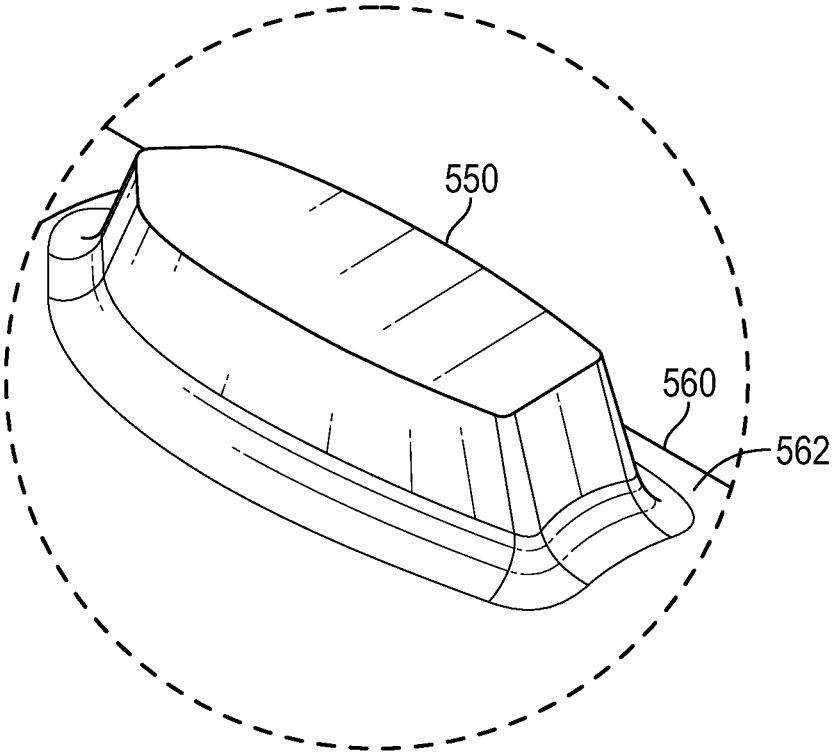
FIG. 23 is a perspective view of another embodiment of a fin.

The fins may each have an axial length that is defined between a distal axial end, e.g., illustrated ends 270, 370, 470, 470, 570 and a proximal axial end, e.g., illustrated ends 272, 372, 472, 572, that is axially spaced apart from the distal axial end. The axial length of a fin may be from about 2 inches to about 2.75 inches. For example, the axial length of a fin may be about 2.05 inches, 2.22 inches, 2.3 inches, 2.4 inches, 2.5 inches, or 2.75 inches. In another embodiment, the fin axial length can be in a range, such as about 2.0 inches to about 2.75 inches. The fins may also comprise a portion that tapers into the body to form a blended radius. The blended radius may be employed to reduce turbulence of a fluid flowing about the fin and body, or parasitic interference drag. The axial length of a fin may be defined as including the blended radius, or at locations adjacent the beginning start of the blended radius. An example of a blended radius 500 is illustrated in FIG. 5.

The fins each also have a circumferential width that is defined between a first radial end, e.g., illustrated first radial ends 280, 380, 480, 580, and a second radial end, e.g., second radial end 282, 382, 482, 582, that is circumferentially spaced apart from the first radial end. The circumferential width may be from about 0.613 inches to about 0.87 inches. The circumferential width may be constant along the axial length or may vary. For example, the circumferential width may be about 0.81 inches, 0.82 inches, 0.87 inches, 0.73 inches, 0.83 inches, 0.875 inches, or 0.613 inches. In another embodiment, the width can be in a range, such as about 0.6 inches to about 0.9 inches. The fin thickness at the root can be a function of the fin taper. Alternatively, the tip thickness can be a function of the thickness at the root and fin taper. In another example, the circumferential width may vary by tapering from about 0.875 inches to 0 inches to form a teardrop shape, when the fin is viewed from a radial direction. The circumferential width may be defined as including the blended radius, or at locations adjacent the beginning start of the blended radius.

The fins may comprise a plurality of fins that couple to, or that are integral and monolithic with, an outer surface of a body. The body may comprise an axis A, and the axis A and the outer surface may define a circumference of the body. The plurality of fins may comprise a first pair of fins, such as the first pair of fins 252 illustrated in FIG. 4, which are axially aligned with each other and circumferentially spaced from each other. The plurality of fins may also comprise a second pair of fins, such as the second pair of fins 254 illustrated in FIG. 4, that are axially spaced a first distance from the first pair of fins, and the second pair of fins are axially aligned with each other and circumferentially spaced from each other. In one example, the body may comprise of no other fins than the first and the second pairs of fins 252, 254. In another example, the body may comprise of no other fins than the first pair of fins 252 and a third fin, such as one of the pairs of fins 254.

Figure 4:
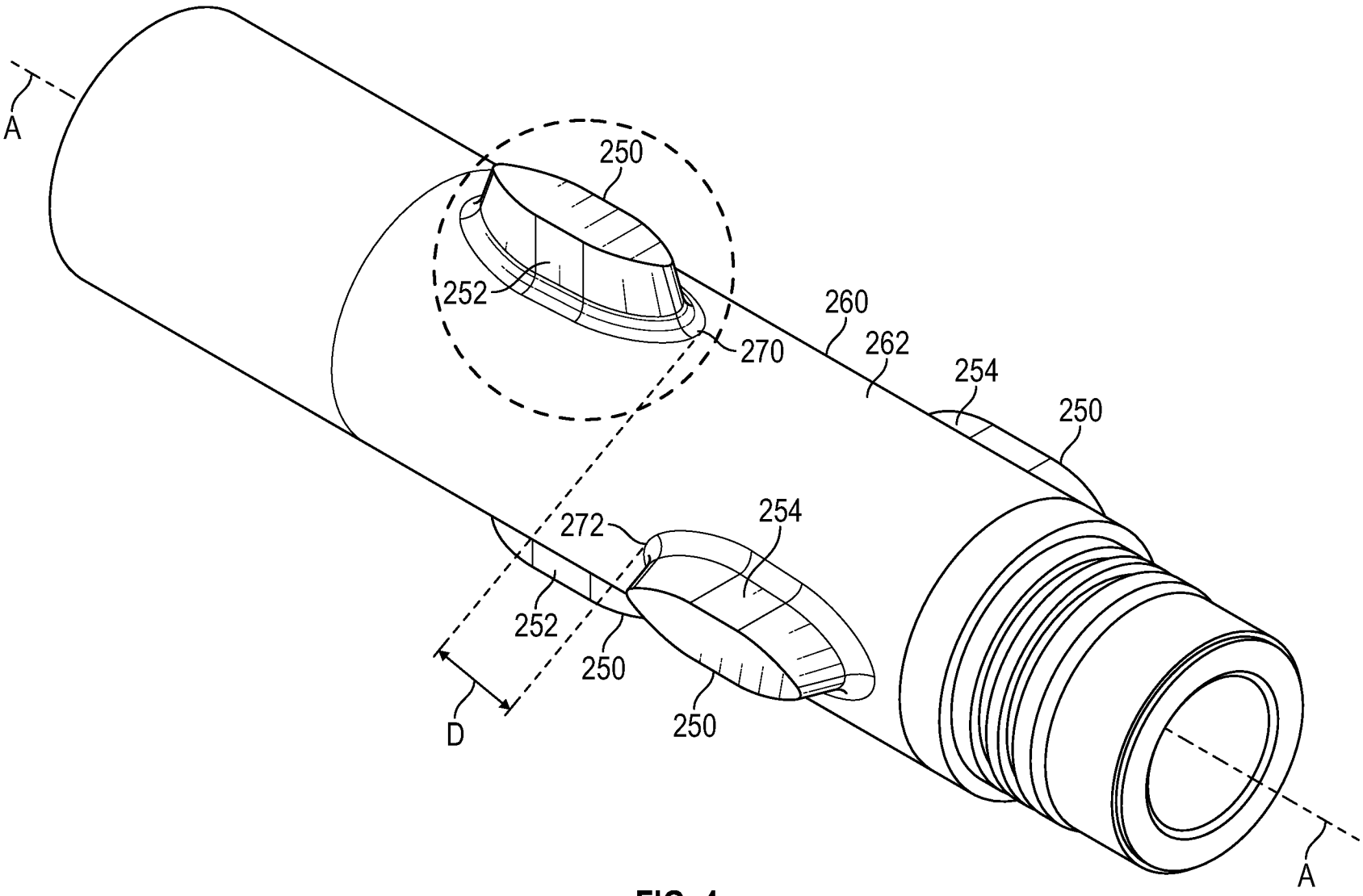
FIG. 4 illustrates a perspective view of an embodiment of a centralizer and fins.

The pairs of fins, such as the pairs of fins 252, 254, may be axially spaced from each other by a distance, such as distance D illustrated in FIG. 4. The distance D can be described in terms of a ratio of the longitudinal length of a fin (e.g., chord line, from leading edge (LE) to trailing edge (TE)) to distance D. Alternatively, the distance D may be a first distance and defined as an axial distance between a distal axial end 270 of one fin of the first pair of fins 252 and a proximal axial end 272 of one fin of the second pair of fins 254. The distance D may be at least 1.11 inches to about 1.83 inches. The distance D may be a first distance and defined as an axial distance between a distal axial end of one fin of the first pair of fins and a proximal axial end of one fin of the second pair of fins. The distance D may be any distance greater than about 1 inches. The axial spacing between the pair of fins may be configured to minimize, prior to flowing about the second pair of fins, the turbulence that is present in a fluid following its flow about the first pair of fins. The distance D is set such that flow stabilizes and fluid velocity is reduced to acceptable range (with respect to fluid erosion limitations), when subject fluid flow velocities encountered in modern rock drilling operations.

The fins, such as fins 150 that are illustrated in FIG. 3, may also be circumferentially spaced from, but axially aligned with, each other. In some embodiments, such as those illustrated in FIGS. 3 and 4, the first pair of fins 252 and the second pair of fins 254 are circumferentially offset from each other. The pairs of fins 252, 254 may each be circumferentially offset from each other by about 90 degrees. The pairs of fins 252, 254 may each be circumferentially spaced apart from each other by about 180 degrees. In some embodiments, the first pair of fins 152 may be circumferentially spaced apart from each other by 90 degrees and the second pair of fins 154 may be circumferentially spaced apart from each other by 180 degrees. In some embodiments, the first pair of fins 252 may be circumferentially spaced apart from each other by 90 degrees and the second pair of fins 254 may be circumferentially spaced apart from each other by 90 degrees. In some embodiments, the first pair of fins 252 may be circumferentially spaced apart from each other by 180 degrees and the second pair of fins 254 may be circumferentially spaced apart from each other by 180 degrees. In some embodiments, the first pair of fins 252 may be circumferentially spaced apart from each other by 180 degrees and the second pair of fins 254 may be circumferentially spaced apart from each other by 90 degrees. It should be appreciated that the fins 250 or pairs of fins 252, 254 may be circumferentially offset by any degree, such as 120 degrees, less than or equal to 180 degrees, greater than or equal to 90 degrees, etc. It should also be appreciated that reference to the axial, radial and circumferential spacing of the pairs of fins 252, 254, is exemplary and such spacing may be suitable for any embodiment of the disclosed fins herein. In addition, and unless otherwise defined, as used here "180 degrees" is intended to mean equal to or less than 180 degrees, and "90 degrees" is intended to mean equal to or less than 90 degrees.

In some embodiments, the fins, when viewed in a radial direction relative to the axis, may comprise a teardrop shape. The teardrop can be a continuously changing curve described by a fourth-order univariate polynomial function (of half the circumferential width, or fin half-thickness) with roots at the location of the leading edge and trailing edge of the shape. Teardrop fin geometry can include symmetrical curves that may be described by the distance from the (foil chord line, LE to TE), such as by the following equation:

$$y_T = \frac{T}{0.2}\left(a_0x^{0.5} + a_1 + a_2x^2 + a_3x^3 + a_4x^4\right)$$

Where, $a_0$-$a_4$ are coefficients according to the shape desired, and T is maximum desired fin thickness for a fin of chord length (longitudinal axis)=1. For example, and with reference to FIGS. 11-16, the fin 450, when viewed in a radial direction comprises a teardrop shape. The proximal axial end 372 of the teardrop shape may define one or more radius of curvatures. The distal axial end 370 of the teardrop shape may define a single radius, or a sharp edge. The sharp edge may define a radius of curvature of about 0.05 inches. The radius of curvature of the sharp edge may bet equal to or less than 0.05 inches. The radius can be a scalar from either the leading edge radius or some other relationship. For example, 5-10% of the maximum radius along the curvature of the teardrop surface could be designated for the radius along the lateral trailing edge (the "sharp edge"). For example, the maximum radius for a teardrop shape could be about 0.66 inches (0.05/0.66=7.5%).

Figure 24:
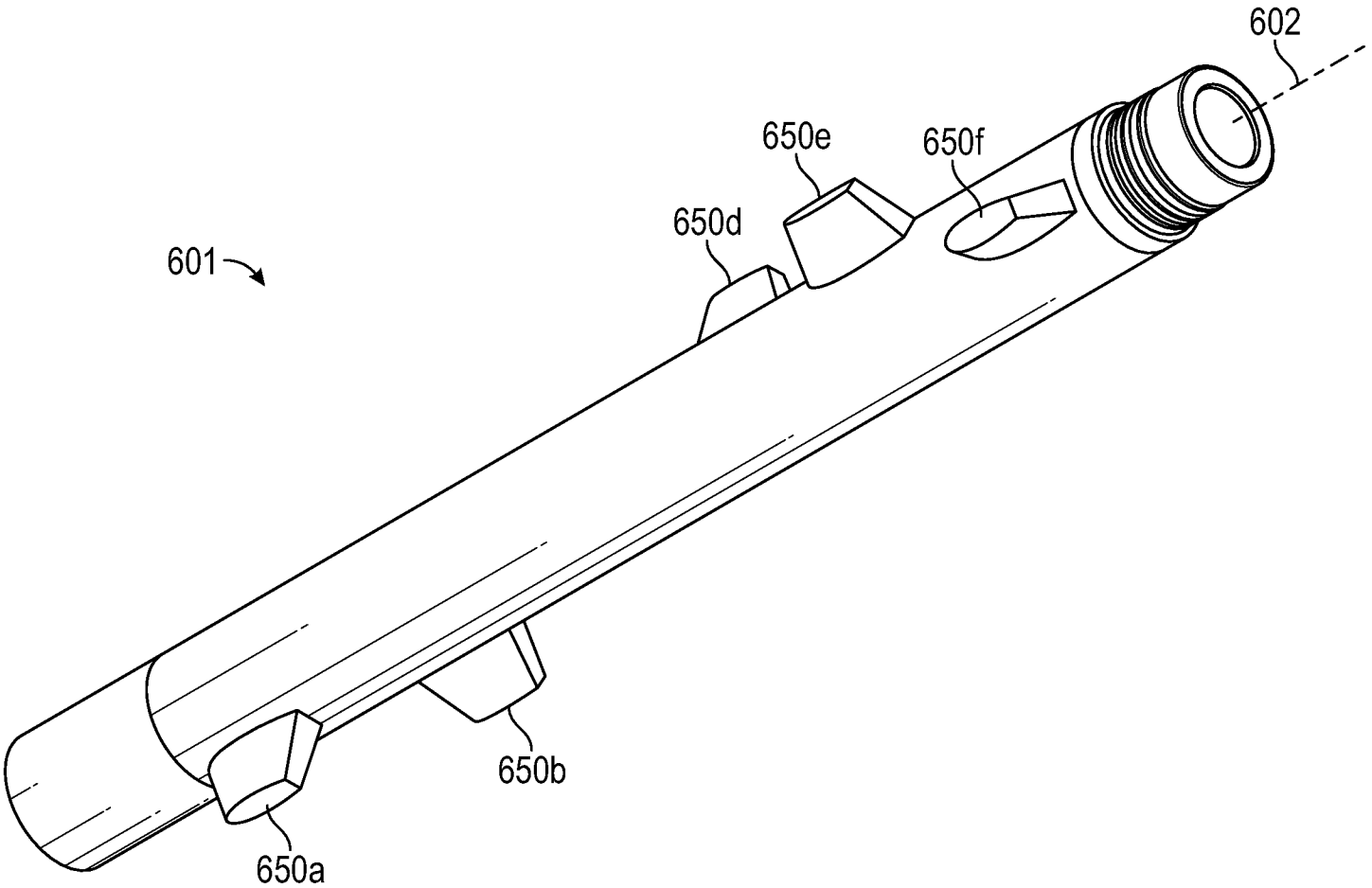
FIG. 24 is a perspective view of still another embodiment of a centralizer.
Figure 25:
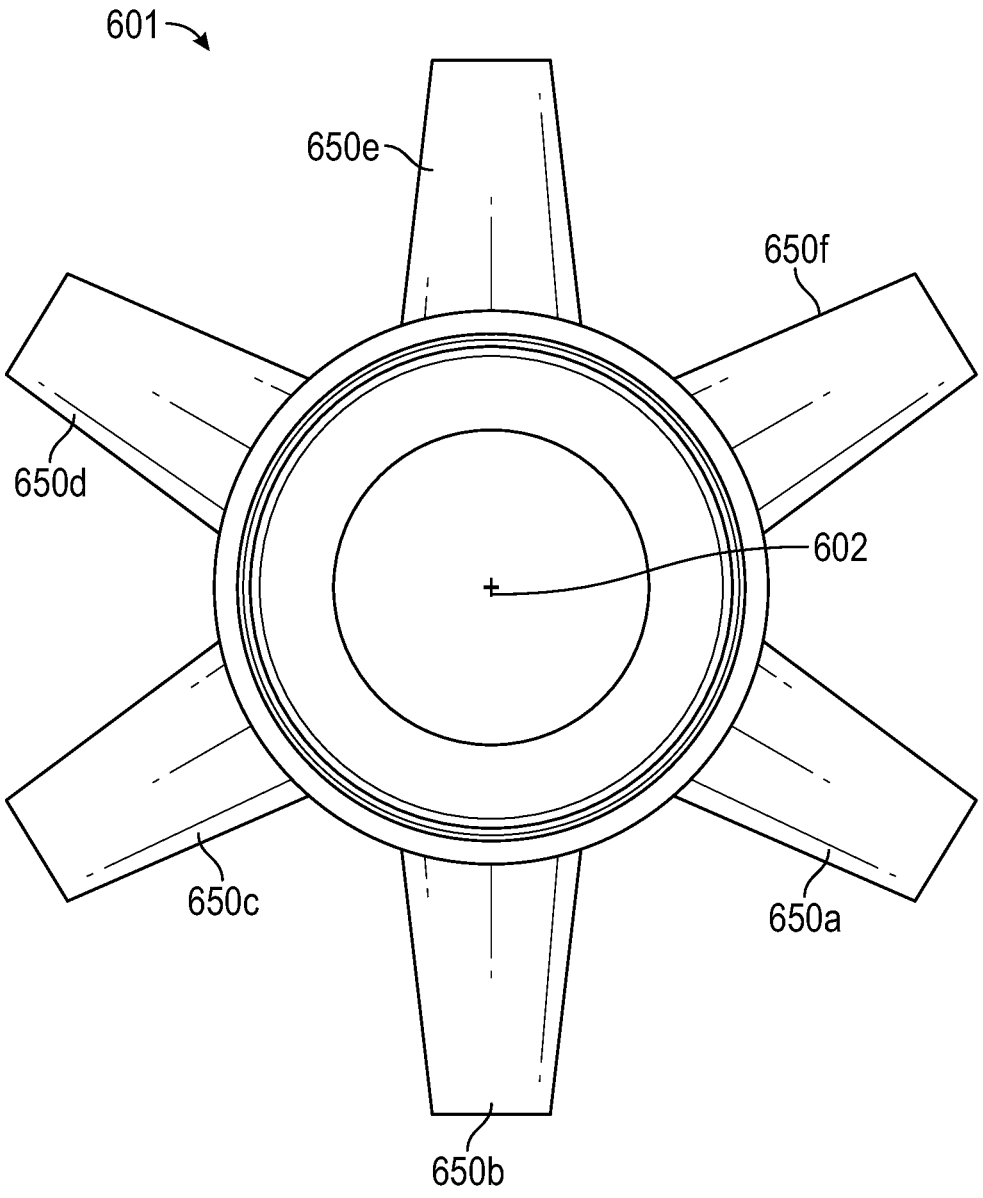
FIG. 25 is an axial end view of the centralizer of FIG. 24.

FIGS. 24-25 depict an alternative embodiment where the fins 650 are arranged in a spiral array or configuration on a downhole tool, such as a centralizer 601. In this example, each fin 650 is axially spaced-apart from the others in a spiral-like pattern around the centralizer 601. Embodiments of the fins 650 may be distributed around the centralizer 601 in a symmetric pattern (as shown), or in an asymmetric pattern. In the illustrated embodiment, there is a total of six fins 650 that are evenly spaced apart from circumferentially adjacent fins 650 by 60 angular degrees about the 360 degree circumference of the centralizer 601.

Other embodiments, however, may comprise more or a lesser number of fins 650, and the fins 650 can be circumferentially spaced apart as desired. Moreover, the axial separations between adjacent ones of the fins 650 can be consistent or inconsistent. In the example illustrated, the six fins 650 are grouped in two groups of three fins 650, with each group being adjacent opposite axial ends of the centralizer 650. The first group comprises fins 650*a-c*, and the second group comprises fins 650*d-f*. The axial distance between the first and second group of fins 650 (e.g., the axial distance between fins 650*c* and 650*d*) may be the same or different than the axial separation between other adjacent ones of the fins 650.

The fins 650 may comprise any of the shapes disclosed herein. All of the fins 650 may comprise the same shape, or more than one shape.

Other embodiments may include one or more of the following items.

1. A centralizer for stabilizing fluid flow through a hollow shaft, the centralizer comprising:

a body having an axis and an outer surface with a circumference;

a plurality of fins extending from the body and comprising:

a first pair of fins that are axially aligned with each other and circumferentially spaced apart from each other; and a second pair of fins that are axially aligned with each other and circumferentially spaced apart from each other; and wherein the first pair of fins is axially spaced apart from the second pair of fins by an axial space; and the first and second pairs of fins are circumferentially offset from each other.

2. The centralizer wherein the first and second pairs of fins are circumferentially offset from each other by about 90 degrees.

3. The centralizer wherein the first pair of fins are circumferentially spaced apart from each other by about 180 degrees.

4. The centralizer wherein the second pair of fins are circumferentially spaced apart from each other by about 180 degrees.

5. The centralizer wherein each fin has a portion that tapers into the body to form a blended radius.

6. The centralizer wherein:

each fin has an axial length defined between an axial leading edge and an axial trailing edge;

each fin has a circumferential width defined in a circumferential direction; and the axial leading and trailing edges are not symmetric when viewed in a radial direction.

7. The centralizer wherein the axial space is from a trailing edge of the first pair of fins to a leading edge of the second pair of fins, and the axial space is at least about 1 inch and not greater than about 3 inches.

8. The centralizer wherein each fin, when viewed in a radial direction, comprises a teardrop shape having a fin geometry described by a distance from a foil chord line, leading edge to trailing edge, by the equation:

$$y_=T/0.2(a_0\times\hat{}0.5+a_1+a_2\times\hat{}2+a_3\times\hat{}3+a_4\times\hat{}4)$$

where a0-a4 are coefficients of a desired shape, and T is a maximum desired fin thickness for a fin of chord length=1.

9. The centralizer wherein each fin, when viewed in a radial direction, comprises a boat-like shape or a Kamm tail profile.

10. The centralizer wherein the body has an outer diameter, a second body is coupled to the body with a transition, and the second body comprises a second outer diameter that is smaller than the outer diameter of the body.

11. The centralizer further comprising an additional set of fins extending from the second body, and the additional set of fins are axially aligned with each other and circumferentially spaced-apart from each other.

12. The centralizer wherein the body consists of the first and second pairs of fins, such that the body has no other fins.

13. A centralizer for a downhole tool, the centralizer comprising:

a body having an axis and an outer surface with a circumference;

first and second fins extending radially from the body opposite each other, and the first and second fins are axially aligned with each other;

third and fourth fins extending radially from the body and, collectively, the third and fourth fins are axially spaced apart from the first and second fins by an axial space;

each fin has an axial leading edge and an axial trailing edge that are not symmetric when viewed in a radial direction; and the body consists of the first, second, third and fourth fins, such that the body has no other fins.

14. The centralizer wherein:

the first and second fins are circumferentially spaced apart from each other by about 180 degrees;

the third and fourth fins are circumferentially spaced apart from each other by about 180 degrees; and the first and second fins are circumferentially offset from the third and fourth fins by about 90 degrees.

15. The centralizer wherein each fin has a portion that tapers into the body to form a blended radius.

16. The centralizer wherein the axial space is from the axial trailing edge of the first or second fin to the axial leading edge of the third or fourth fin, and the axial space is at least about 1 inch and not greater than about 3 inches.

17. The centralizer wherein each fin, when viewed in a radial direction, comprises a teardrop shape having a fin geometry described by a distance from a foil chord line, leading edge to trailing edge, by the equation:

$$y_=T/0.2(a_0\times\hat{}0.5+a_1+a_2\times\hat{}2+a_3\times\hat{}3+a_4\times\hat{}4)$$

where, a0-a4 are coefficients of a desired shape, and T is a maximum desired fin thickness for a fin of chord length=1.

18. The centralizer wherein each fin, when viewed in a radial direction, comprises a boat-like shape or a Kamm tail profile.

19. The centralizer wherein the body has an outer diameter, a second body is coupled to the body with a transition, and the second body comprises a second outer diameter that is smaller than the outer diameter of the body; and further comprising:

an additional set of fins extending from the second body, and the additional set of fins are axially aligned with each other and circumferentially spaced-apart from each other.

20. A downhole tool, comprising:

a fin body having an axis and a plurality of fins extending radially from the fin body, wherein each fin, when viewed in a radial direction, comprises a shape consisting of a Kamm tail profile.

Consistent with the preceding, the discussions herein are meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications. Moreover, the various aspects, embodiments, implementations, or features of the described embodiments can be used separately or in any combination and are modular in nature. Accordingly, any aspect of the described embodiments may be used in connections with any other disclosed or alternative embodiments.

We claim:

1. A centralizer for stabilizing fluid flow through a hollow shaft, the centralizer comprising:

a body having an axis and an outer surface with an outer diameter and a circumference;

a plurality of fins extending from the body and comprising:

a first pair of fins that are aligned with each other along the axis and circumferentially spaced apart from each other relative to the axis; and a second pair of fins that are aligned with each other along the axis and circumferentially spaced apart from each other relative to the axis;

the first pair of fins is axially spaced apart from the second pair of fins by an axial space;

the first and second pairs of fins are circumferentially offset from each other;

a second body is coupled to the body with a tapered transition, and the second body comprises a second outer diameter that is smaller than the outer diameter of the body; and an additional set of fins extending from the second body, and the additional set of fins are aligned with each other along the axis and circumferentially spaced-apart from each other relative to the axis.

2. The centralizer of claim 1, wherein the first and second pairs of fins are circumferentially offset from each other by about 90 degrees.

3. The centralizer of claim 1, wherein the first pair of fins are circumferentially spaced apart from each other by about 180 degrees.

4. The centralizer of claim 3, wherein the second pair of fins are circumferentially spaced apart from each other by about 180 degrees.

5. The centralizer of claim 1, wherein each fin has a portion that tapers toward the body to form a blended radius that is concave.

6. The centralizer of claim 5, wherein:

each fin has an axial length defined between an axial leading edge and an axial trailing edge;

each fin has a circumferential width defined in a circumferential direction; and the axial leading and trailing edges are not symmetric when viewed in a radial direction.

7. The centralizer of claim 5, wherein the blended radius circumscribes a perimeter of every fin where every fin intersects the body.

8. The centralizer of claim 1, wherein the axial space is from a trailing edge of the first pair of fins to a leading edge of the second pair of fins, and the axial space is at least about 1 inch and not greater than about 3 inches.

9. The centralizer of claim 1 wherein each fin, when viewed in a radial direction, comprises a teardrop shape having a fin geometry described by a distance from a foil chord line, leading edge to trailing edge, by the equation:

$$y_T = \frac{T}{0.2}\left(a_0x^{0.5} + a_1 + a_2x^2 + a_3x^3 + a_4x^4\right)$$

where, $a_0$-$a_4$ are coefficients of a desired shape, and T is a maximum desired fin thickness for a fin of chord length=1.

10. The centralizer of claim 1 wherein each fin, when viewed in a radial direction, comprises a boat-like shape or a Kamm tail profile.

11. The centralizer of claim 1, wherein the body consists of the first and second pairs of fins, such that the body has no other fins.

12. A centralizer for a downhole tool, the centralizer comprising:

a body having an axis and an outer surface with a circumference;

first and second fins extending radially from the body opposite each other relative to the axis, and the first and second fins are aligned with each other along the axis;

third and fourth fins extending radially from the body and, collectively, the third and fourth fins are axially spaced apart from the first and second fins by an axial space;

each fin has an axial leading edge and an axial trailing edge that are not symmetric when viewed in a radial direction; and the body consists of the first, second, third and fourth fins, such that the body has no other fins; and wherein each fin, when viewed in a radial direction, comprises a teardrop shape having a fin geometry described by a distance from a foil chord line, leading edge to trailing edge, by the equation:

$$y_T = \frac{T}{0.2}\left(a_0x^{0.5} + a_1 + a_2x^2 + a_3x^3 + a_4x^4\right)$$

where, $a_0$-$a_4$ are coefficients of a desired shape, and T is a maximum desired fin thickness for a fin of chord length=1.

13. The centralizer of claim 12, wherein:

the first and second fins are circumferentially spaced apart from each other by about 180 degrees;

the third and fourth fins are circumferentially spaced apart from each other by about 180 degrees; and the first and second fins are circumferentially offset from the third and fourth fins by about 90 degrees.

14. The centralizer of claim 12, wherein each fin has a portion that tapers toward the body to form a blended radius that is concave.

15. The centralizer of claim 12, wherein the axial space is from the axial trailing edge of the first or second fin to the axial leading edge of the third or fourth fin, and the axial space is at least about 1 inch and not greater than about 3 inches.

16. The centralizer of claim 12 wherein each fin, when viewed in a radial direction, comprises a boat-like shape or a Kamm tail profile.

17. The centralizer of claim 12, wherein the body has an outer diameter, a second body is coupled to the body with a tapered transition, and the second body comprises a second outer diameter that is smaller than the outer diameter of the body.

18. The centralizer of claim 14, wherein the blended radius circumscribes a perimeter of every fin where every fin intersects the body.

* * * * *